US008330617B2

(12) United States Patent
Chen et al.

(10) Patent No.: US 8,330,617 B2
(45) Date of Patent: Dec. 11, 2012

(54) WIRELESS POWER AND TELEMETRY TRANSMISSION BETWEEN CONNECTIONS OF WELL COMPLETIONS

(75) Inventors: Kuo-Chiang Chen, Sugar Land, TX (US); Yasser Mahmoud El-Khazindar, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 608 days.

(21) Appl. No.: 12/558,029

(22) Filed: Sep. 11, 2009

(65) Prior Publication Data

US 2010/0181067 A1 Jul. 22, 2010

Related U.S. Application Data

(60) Provisional application No. 61/145,343, filed on Jan. 16, 2009.

(51) Int. Cl.
*G01V 3/00* (2006.01)

(52) U.S. Cl. ..... 340/854.6; 340/854.3

(58) Field of Classification Search ..... 340/854.6, 340/854.3, 854.7, 855.4
See application file for complete search history.

(56) References Cited

U.S. PATENT DOCUMENTS

| | | | |
|---|---|---|---|
| 6,163,276 | A | 12/2000 | Irving |
| 6,360,820 | B1 | 3/2002 | Laborde |
| 6,464,011 | B2 | 10/2002 | Tubel |
| 6,747,569 | B2 | 6/2004 | Hill |
| 6,768,700 | B2 | 7/2004 | Veneruso |
| 6,789,621 | B2 | 9/2004 | Wetzel |
| 7,114,561 | B2 | 10/2006 | Vinegar |
| 7,224,288 | B2 | 5/2007 | Hall |
| 7,301,474 | B2 | 11/2007 | Zimmerman |
| 7,397,388 | B2 | 7/2008 | Huang |
| 2003/0192692 | A1 | 10/2003 | Tubel |
| 2005/0167098 | A1 | 8/2005 | Lovell |
| 2005/0263287 | A1 | 12/2005 | Achee |
| 2006/0086497 | A1 | 4/2006 | Ohmer |
| 2006/0124297 | A1 | 6/2006 | Ohmer |
| 2006/0124310 | A1 | 6/2006 | Lopez de Cardenas |
| 2006/0260806 | A1 | 11/2006 | Moriarty |
| 2007/0194947 | A1 | 8/2007 | Huang |
| 2007/0227727 | A1 | 10/2007 | Patel |
| 2008/0041575 | A1 | 2/2008 | Clark |
| 2008/0042869 | A1 | 2/2008 | Zimmerman |
| 2008/0236837 | A1 | 10/2008 | Lovell |
| 2009/0045974 | A1* | 2/2009 | Patel ..... 340/854.6 |
| 2009/0151950 | A1 | 6/2009 | Patel |
| 2010/0243243 | A1* | 9/2010 | Chen et al. ..... 166/250.15 |

* cited by examiner

*Primary Examiner* — Peguy Jean Pierre

(57) ABSTRACT

An intelligent well system may include a first main bore transmission assembly disposed in a main bore and a first lateral bore transmission assembly disposed in a lateral bore. The first main bore transmission assembly may include a first main bore transmission unit, and the first lateral bore transmission assembly may include a first lateral bore transmission unit. The first main bore transmission unit and the first lateral bore transmission unit may be configured to establish a wireless connection there between, such that at least one of power or telemetry can be wirelessly transmitted. The first main bore transmission assembly may be configured to be communicatively connected to a surface communication device.

18 Claims, 3 Drawing Sheets

WIRELESS POWER AND TELEMETRY TRANSMISSION BETWEEN CONNECTIONS OF WELL COMPLETIONS

RELATED APPLICATIONS

This application claims the benefit of U.S. Provisional Application No. 61/145,343, filed Jan. 16, 2009, entitled "WIRELESS POWER AND TELEMETRY TRANSMISSION BETWEEN CONNECTIONS OF WELL COMPLETIONS," by Kuo Chiang Chen et al., the contents of which are herein incorporated by reference.

BACKGROUND

1. Field of the Invention

Embodiments of the present invention relate generally to well communication technologies, and more particularly to intelligent well technologies, although it is understood that this is a non-limiting generalization.

2. Description of the Related Art

The following descriptions and examples are not admitted to be prior art by virtue of their inclusion in this section.

Hydrocarbon fluids such as oil and natural gas are obtained from a subterranean geological formation, often referred to as a reservoir, by drilling a wellbore that penetrates or provides access to the hydrocarbon-bearing formation. In order to effectively and efficiently produce or obtain these scarce resources, many hydrocarbon wells today utilize intelligent well technologies to monitor specific wellbore parameters and downhole reservoir information such as fluid flow rate, temperature, pressure, and resistivity, among others. Based on the information obtained, the well system may be modified or altered to account for changes in operating circumstances such as formation flows or water intrusion, for example.

Intelligent wells, which can be used either on land or in offshore areas, typically include monitoring equipment and completion components (such as sensors and production tubing, among others) and allow reservoir fluid flow to be controlled without physical intervention. Intelligent wells may also have valves and inflow control devices that may be actuated in order to control the flow through a well system. Proper implementation of an intelligent well system depends on energy and signal transmissions between the surface and one or more downhole locations. Downhole connections for energy and signals within a wellbore completions may also significantly contribute to proper implementation.

FIG. 1 shows a simplified example of a conventional prior art well system with a well 100 and a borehole 110. The borehole 110 in this example is cased and extends through two reservoir formations, 60 and 70. The reservoir formations 60, 70 contain desirable fluid, such as hydrocarbons or water for example. The well system may contain production tubing 130 and one or more downhole devices 18, 19, provided to allow access to the production tubing 130. In a conventional well system, the downhole devices 18 and 19 may be set at the surface prior to run-in. Alternatively, an intervention may be performed after completion and the downhole devices 18, 19 operated via slickline or wireline. However, a conventional well system may not include any devices or conduits to transfer power or communicate downhole information to the surface.

SUMMARY OF INVENTION

One embodiment of the well system may generally relate to an intelligent well system including a first main bore transmission assembly disposed in a main bore and a first lateral bore transmission assembly disposed in a lateral bore. The first main bore transmission assembly may include a first main bore transmission unit, and the first lateral bore transmission assembly may include a first lateral bore transmission unit. The first main bore transmission unit and the first lateral bore transmission unit may be configured to establish a wireless connection there between, such that at least one of power or telemetry can be wirelessly transmitted. The first main bore transmission assembly may be configured to be communicatively connected to a surface communication device.

Another embodiment of the well system may generally relate to a method of transmitting data and energy through an intelligent well system. The method may include disposing a first main bore transmission assembly in a main bore and disposing a first lateral bore transmission assembly in a lateral bore. In addition, the method may include establishing a wireless connection between the first main bore transmission assembly and the first lateral bore transmission assembly, such that at least one of power or telemetry can be wirelessly transmitted. The method may further include connecting the first main bore transmission assembly to a surface communication device.

Other embodiments and advantages of the well system will be apparent from the following description and the appended claims.

BRIEF DESCRIPTION OF DRAWINGS

Certain embodiments of the invention will hereafter be described with reference to the accompanying drawings, wherein like reference numerals denote like elements. It should be understood, however, that the accompanying drawings illustrate only the various implementations described herein and are not meant to limit the scope of various technologies described herein. The drawings are as follows.

DETAILED DESCRIPTION

Exemplary embodiments of the invention will be described below with reference to the accompanying figures.

In the following description, numerous details are set forth to provide an understanding of the various embodiments of the present invention. However, it will be understood by those of ordinary skill in the art that the present invention may be practiced without these details and that numerous variations or modifications from the described embodiments may be possible. In the specification and appended claims: the terms "connect", "connection", "connected", "in connection with", "connecting", "couple", "coupled", "coupled with", and "coupling" are used to mean "in direct connection with" or "in connection with via another element"; and the term "set" is used to mean "one element" or "more than one element". As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the invention.

An intelligent well system in accordance with one or more embodiments of the present invention may include one or more main bore transmission assemblies configured to be disposed in one or more zones of a main bore. In addition or alternatively, some embodiments of a well system may include one or more lateral bore transmission assemblies configured to be disposed in one or more lateral bores that intersect or communicate with the main bore. Each lateral bore may also include one or more production zones.

Each of the transmission assemblies may include one or more transmission units configured to establish a wireless connection with transmission units of the other transmission assemblies. Each of the transmission assemblies may also include one or more sensors and/or actuators. Further, one of the transmission assemblies may be configured to be communicatively connected to a surface communication device. The use of a surface communication device configuration enables efficient monitoring and control of multiple zone segments of a reservoir. More specifically, for example, a well system in accordance with one or more embodiments can obtain position feedback from valves and control devices located downhole, and transmit at least one of data or power to and from the surface as well as across multiple bore junctions.

Figure 1:
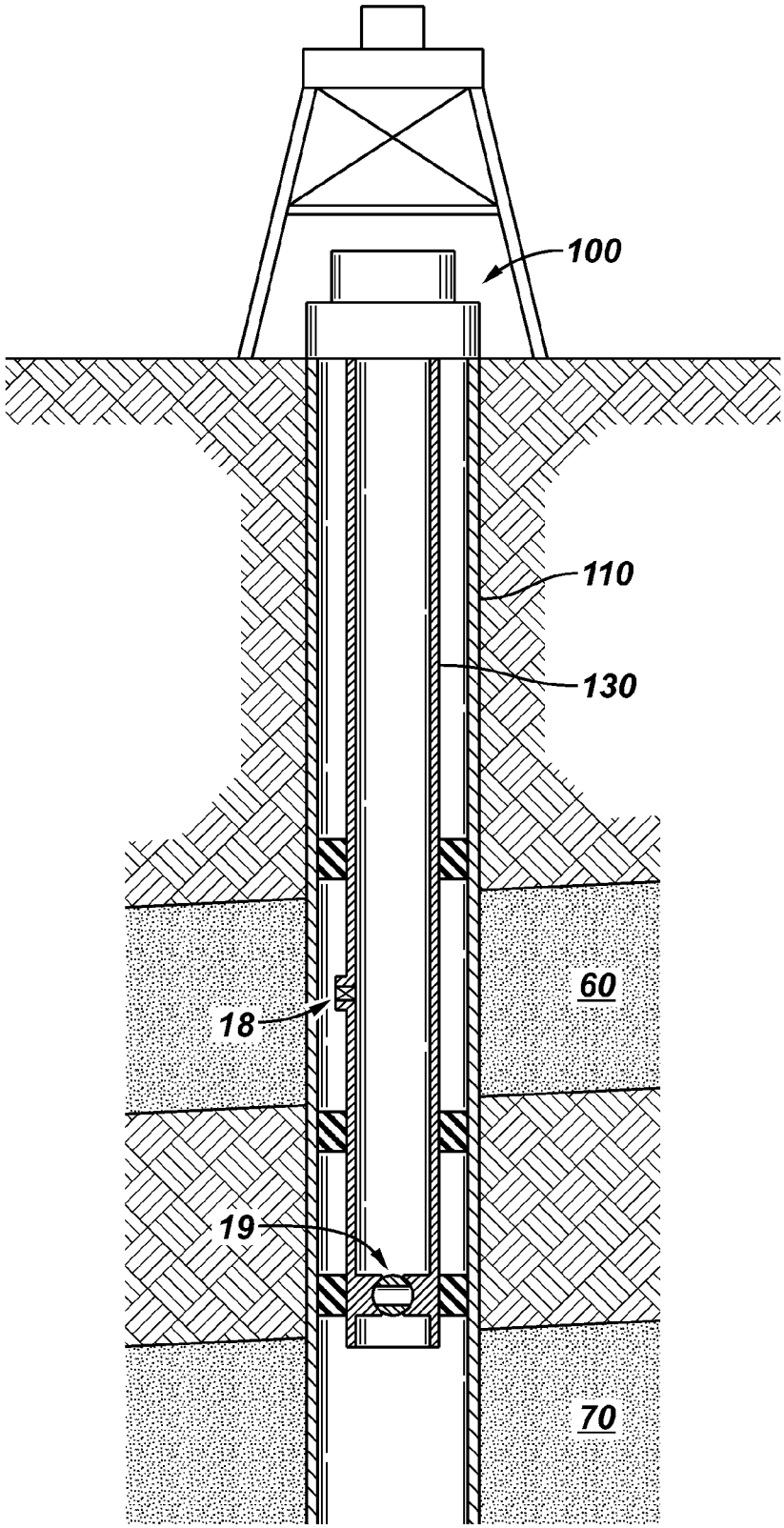
FIG. 1 shows a schematic view of a prior art conventional well system.
Figure 2:
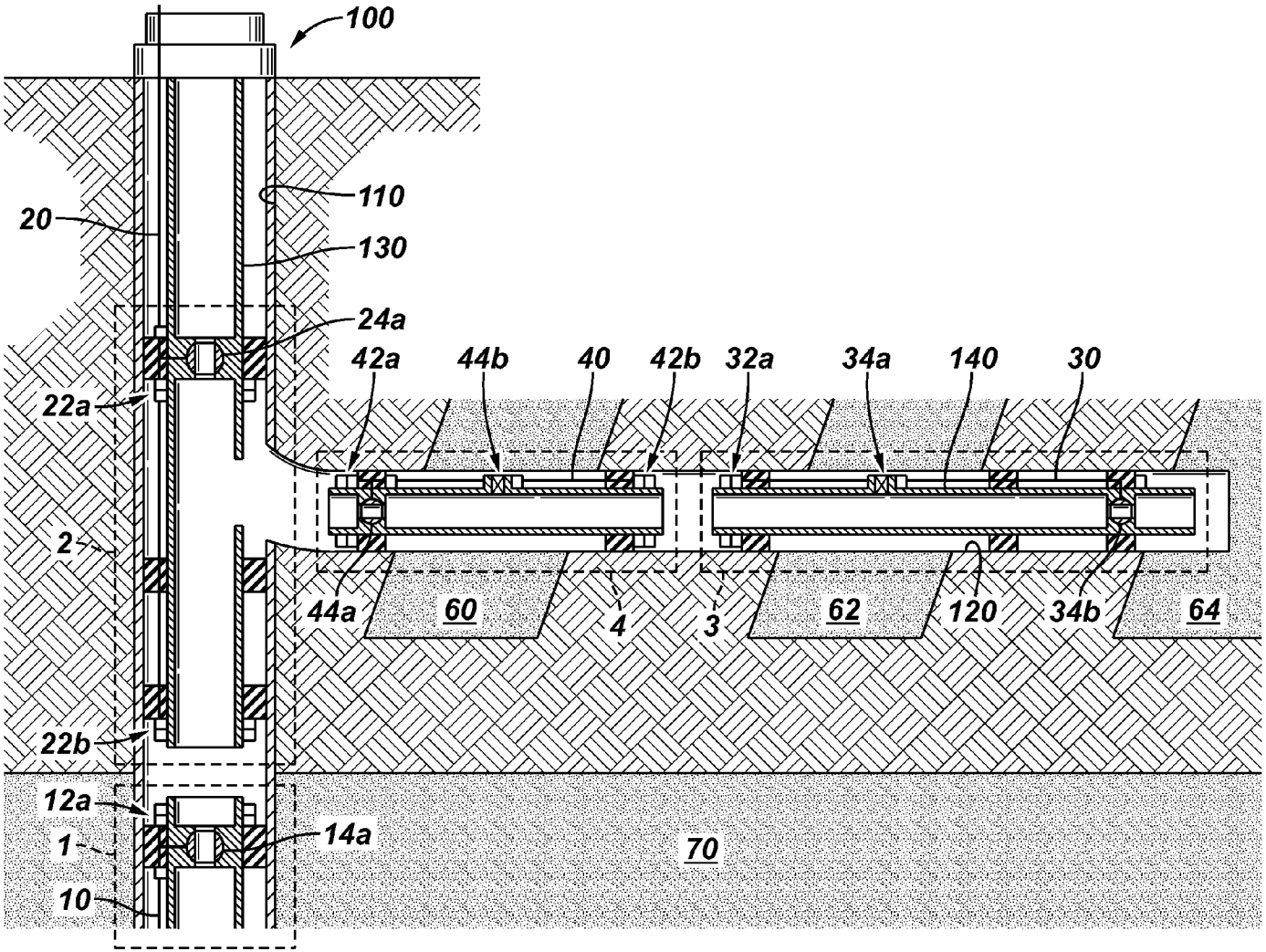
FIG. 2 shows a schematic view of an intelligent well system in accordance with one or more embodiments of the present invention.

Referring generally to FIG. 2, this figure illustrates an intelligent well system in accordance with one or more embodiments of the present invention. In this example, a well 100 includes a main bore 110 and a single lateral bore 120. The main bore 110 extends upward to a surface of the well 100, which may be either a subsea or terrestrial surface. Although the main bore 110 is shown as substantially vertical, this is only for the purpose of simplification, a well 100 may comprise a deviated or partially deviate main bore. The bores 110 and 120 are configured to intersect or interact with hydrocarbon formations. As shown, the main bore 110 extends through formation 70 while the lateral bore 120 extends through formation zones 60, 62, and 64. Aspects of this embodiment may also be applied to, e.g., single-bore multi-zone wells, lateral single zone wells, multilateral-bore wells, etc., and various combinations thereof. The bores 110 and 120 may be cased (i.e., lined) or open-hole. In this illustrative example, the main bore 110 is cased and the lateral bore 120 is an open-hole bore.

The main bore 110 may include production tubing 130. The production tubing 130 may be substantially continuous or comprising a number of separate sections. In some embodiments, the completion containing the production tubing 130 may be made in multiple stages or trips, such as with an upper and lower completion for example. The lateral bore 120 may also include production tubing 140. As with the main bore production tubing 130, the production tubing 140 may also be continuous or comprising a number of separate sections. The production tubing 130, 140 may be sealed through the use of wellbore packers to either the interior surface of the casing or the walls of the open-hole bore in order to control or segment various reservoir sections or zones.

The intelligent well system in accordance with one or more embodiments may include one or more transmission assemblies located within the various bores. Each of the transmission assemblies may be configured to function as an independent module. In addition, each of the transmission assemblies may be disposed to access different zones in a formation. For example, in the embodiment shown in FIG. 2, a transmission assembly 1 and a transmission assembly 2 are disposed in the main bore 110, and a transmission assembly 3 and a transmission assembly 4 are disposed in the lateral bore 120.

Each of the transmission assemblies may include one or more communication devices. Further, within each of the transmission assemblies, a conduit connection (which may be referred to as a wired connection) may be used to link the devices within that assembly. In the embodiment shown in FIG. 2, conduits 10, 20, 30, and 40 are used to respectively connect the devices within the transmission assemblies 1, 2, 3, and 4. Conduits 10, 20, 30, and 40 may be electrical cables, fiber optic cables, hybrid combinations of cables, hydraulic control lines, and electro-hydraulic conduits, among others for example. Conduit 20 of the transmission assembly 2 also extends to the surface of the well 100 and can be used to communicatively couple or connect a surface communication device, e.g., transceiver, to the various devices downhole.

More specifically, in FIG. 2, the transmission assembly 1 may include a sensor and actuator pack 14*a*, which is connected to the conduit 10. Transmission assembly 2 may include a sensor and actuator pack 24*a*, which is connected to the conduit 20. In addition, transmission assembly 3 may include sensor and actuator packs 34*a* and 34*b*, which are connected to the conduit 30. Similarly, transmission assembly 4 may include sensor and actuator packs 44*a* and 44*b*, which are connected to the conduit 40.

In one or more embodiments, the sensor and actuator packs may be configured to measure and monitor various wellbore parameters and reservoir conditions such as pressure, temperature, flow rate, density, viscosity, water cut and resistivity, among others. The sensor and actuator packs may each include one or more sensors and/or actuators, and their connections may be independently coupled together within each of the assemblies. Those skilled in the art will appreciate that various types of sensors, e.g., electrical, acoustic, fiber-optic, etc., or combinations thereof, may be used. The connections within each of the assemblies may be made on the surface and then run downhole along with the proper protection for the conduits and associated devices. Alternatively, wireless energy and signal transmission may be used within one or more of the assemblies, to avoid breaching a packer assembly for example. Further, in one or more embodiments, one or more of the sensor and actuator packs in the well (both in the main bore and in any lateral bores) may be powered and connected through either wired or wireless power and telemetry.

In some embodiments, the sensor and actuator packs may be used to control the actions of various downhole tools. For example, formation isolation valves (FIV), such as those represented in sensor and actuation packs 24*a* and 44*a*, may be used to shut off or prevent various bores from communication with the well head 100. This may occur during completion of a well or when a well is suspended, among other situations. Other downhole tools, such as inflow control devices (ICD) represented in sensor and actuation packs 14*a*, 34*b*, and 44*a*, may be used to balance production across the various zones or to prevent the flow from a zone contaminated by water, among other situations. Of course, the downhole tools actuated by the sensor and actuation packs may comprise any of a wide variety of downhole tools, including, but not limited to, electric submersible pumps (ESP), generator and storage devices, packers, and injection valves, among others.

In one or more embodiments, the connections between the main bore(s) and the lateral bore(s) may be made in-situ downhole. A wireless transmission unit, which may be configured to transmit and/or receive power and/or telemetry, may be used to establish these connections. For example, referring again to FIG. 2, a wireless transmission unit 22*a* provided in the main bore and a wireless transmission unit 42*a* provided in the lateral bore 120 can establish a pathway for the transmission of energy and signals between the transmission assemblies 2 and 4, thereby facilitating the transmission of energy and signals between the main bore 110 and the lateral bore 120. Likewise, a wireless transmission unit 42*b* of the transmission assembly 4 and a wireless transmission unit 32*a* of the transmission assembly 3 can establish a pathway for the transmission of energy and signals between the transmission assemblies 3 and 4, and a wireless transmission unit

22*b* of the transmission assembly 2 and a wireless transmission unit 12*a* of the transmission assembly 1 can provide for a pathway for the transmission of energy and signals between the transmission assemblies 1 and 2. It will be apparent to those skilled in the art that the scope of the present invention is not limited to the particular implementation described above, and that various downhole wireless and power-telemetry networks can be established across numerous zones of the bore formation consistent with embodiments of the present invention. Further, the scope of the present invention is not limited to any particular number or orientation of main or lateral bores.

Figure 3:
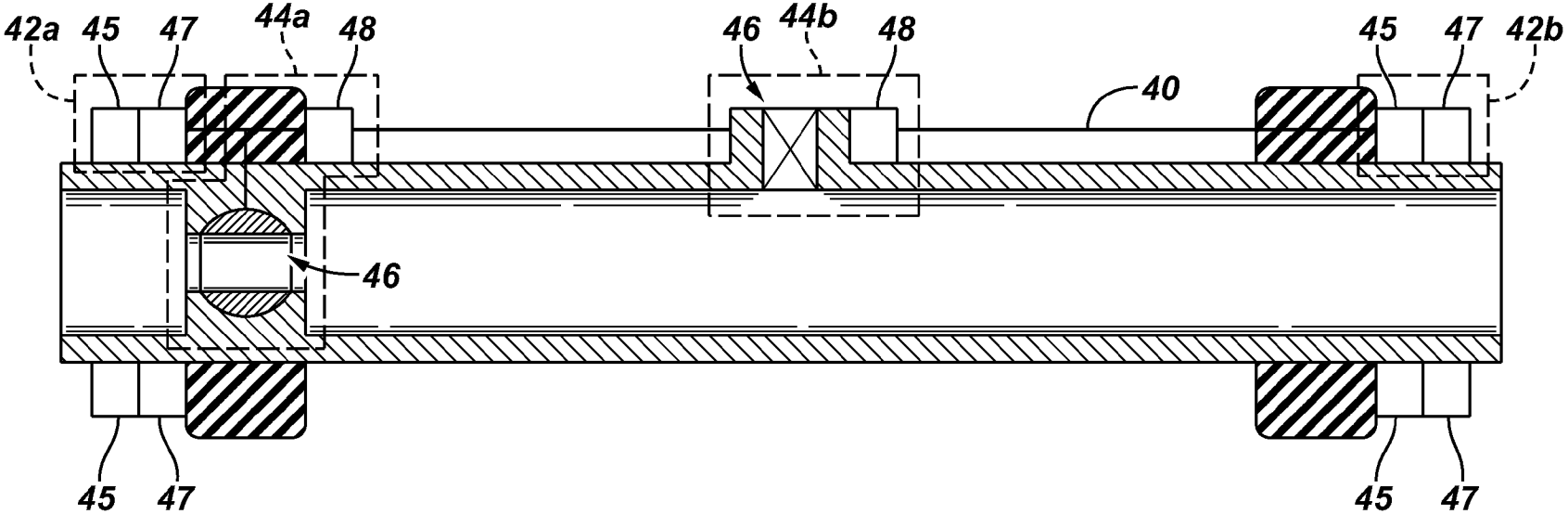
FIG. 3 shows an enlarged schematic view of a transmission assembly of the intelligent well system shown in FIG. 2.

FIG. 3 shows an enlarged schematic view of one of the transmission assemblies, namely the transmission assembly 4, for illustration purposes. As described above, the transmission assembly 4 may include the sensor and actuator packs 44*a* and 44*b* and the wireless transmission units 42*a* and 42*b*. The wireless transmission units 42*a* and 42*b* facilitate the transmission and reception of energy and signals with the other transmission assemblies. Each of these wireless transmission units 42*a* and 42*b* may have a power unit 45 configured to transmit and/or receive power and a telemetry unit 47 configured to transmit and/or receive telemetry. Power and/or telemetry may be exchanged, for example, electromagnetically. Further, each of the sensor and actuator packs may have an actuator 46 and/or a sensor 48 (both are shown in this example). The actuator 46 in the sensor and actuator pack 44*b* may be used to control an ICD while the actuator 46 in the sensor and actuator pack 44*a* may be used to control an FIV. As can be seen, the conduit 40 may be used to couple together some of the various components within the transmission assembly 4.

Those skilled in the art will appreciate that various modifications to the above configuration can be made without departing from the spirit of the present invention. Numerous examples are provided below for illustration purposes.

Even though the junction between the main bore 110 and the lateral bore 120 in FIG. 2 is depicted as an open hole connection, various other types of junctions and connections between the main bore and lateral bore(s) may be used. For example, in one or more embodiments, cased, cemented, and tubular junctions and connections, among others, may be used between the main bore and the lateral bore(s).

Further, although the transmission units in FIG. 2 are shown at the terminals or ends of each transmission assembly and proximate to the junction between the main bore 110 and the lateral bore 120, embodiments of the present invention are not limited to these locations. In addition, power and telemetry devices are not required to be present simultaneously. Some assemblies may only require power devices while others may only require telemetry devices.

The form of the power and telemetry transmissions may be in the form of electrical, hydraulic, acoustic, optic, mechanical, and electro-magnetic, among others. The power transmissions are not required to be in the same form as the telemetry transmissions. In addition, combinations or conversions of forms, such as from optical transmission into electric power, may also be present.

The generation of power and telemetry may be either centralized on the surface or distributed in-situ down hole. Power may be generated on the surface and converted from one form to another downhole. In addition, power may be harvested in-situ downhole, such as through piezo-electric power generation devices and downhole turbines configured to convert the mechanical energy of vibrations and fluid flow into energy. Further, power and telemetry may be transmitted and received between the surface and locations downhole or between two or more locations downhole.

Those skilled in the art will appreciate that specifics of the well system may vary depending on the needs of the particular circumstance or drilling site. Embodiments of the intelligent well system or the well in which the system is used may take various shapes and forms to address those needs. An intelligent well system in accordance with one or more embodiments of the present invention may be used in combination with other well-known (or later developed) technologies to further enhance downhole management processes, improve system reliability, etc. For example, components of an intelligent well system in accordance with one or more embodiments may be adjusted automatically or with operator intervention, and may utilize computer and software solutions to monitor, analyze, and manage downhole information in a continuous feedback loop. Those skilled in the art will recognize that various other features, which have not been described to avoid obscuring the invention, may also be used with embodiments of the present invention.

In one or more embodiments, transmission of power and telemetry may be either wired or wireless or a combination thereof. "Wired" connections may include physical wires (e.g., for electrical forms of transmission), fiber optics (e.g., for optical forms), control lines (e.g., for hydraulic forms), conduits, etc. The wired connections may be inside, outside, or within the production tubing or casing. For example, an electrical cable may be placed outside of the production tubing, or an electrical line may be imbedded within the production tubing, such as with a wired drill pipe (WDP).

In one or more embodiments, the storage of power and telemetry may include either pre-charged or rechargeable devices. Further, power may be stored by non-rechargeable means, e.g., pressurized nitrogen gas and preloaded springs, among others. Alternatively, power may also be stored by rechargeable means, e.g., rechargeable batteries and capacitor banks, among others. Similarly, telemetry may be either on a one-time/limited-use basis, e.g., releasing chemical tracers or RFID tags, or used repeatedly throughout the life of the well.

In one or more embodiments, the format of supplying power and telemetry may be on-demand. Put another way, power and telemetry need not always be connected between two points of the well because power and telemetry may be connected on demand when it is required to send energy and signals to sensors and actuators. In such a case, the storage of power and telemetry may be eliminated. In other cases, power may be used to trickle-charge a storage device for implementation of a telemetry transmission burst at various intervals.

Intelligent well systems in accordance with one or more embodiments may provide for more efficient and reliable transmissions between surface and downhole environments as compared with conventional systems. For example, sensors, valves, and other control devices located downhole can be operated to transmit at least one of data and energy to and from the surface as well as across multiple bore junctions. Wireless power transfer and wireless telemetry in accordance with one or more embodiments of the present invention can provide for simple and reliable transmission of energy and signals across each connection and junction of oil and gas wells. Further, wireless transmission devices in accordance with one or more embodiments can eliminate the need for the close proximity of physical/mechanical connections across zones of bore formation. In such a case, the transmission of energy and signals may be decoupled from the inherent complexity of the mechanical connections in well completions.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An intelligent well system comprising:

a first main bore transmission assembly disposed in a main bore and comprising a first main bore transmission unit;

a first lateral bore transmission assembly disposed in a lateral bore and comprising a first lateral bore transmission unit;

a second main bore transmission assembly disposed in the main bore and comprising a second main bore transmission unit;

a second lateral bore transmission assembly disposed in the lateral bore and comprising a second lateral bore transmission unit;

wherein the first main bore transmission unit and the first lateral bore transmission unit are configured to establish a wireless connection there between, such that at least one of power or telemetry can be wirelessly transmitted;

wherein the first main bore transmission assembly is configured to be communicatively connected to a surface communication device;

wherein the first main bore transmission unit and the second main bore transmission unit are configured to establish a wireless connection there between, such that at least one of power or telemetry can be wirelessly transmitted; and wherein the first lateral bore transmission unit and the second lateral bore transmission unit are configured to establish a wireless connection there between, such that at least one of power or telemetry can be wirelessly transmitted.

2. The intelligent well system according to claim 1, wherein each of the transmission assemblies further comprises at least one sensor and at least one actuator.

3. The intelligent well system according to claim 2, wherein each of the transmission assemblies further comprises a conduit connecting the at least one sensor and the at least one actuator within that transmission assembly.

4. The intelligent well system according to claim 2, wherein the at least one sensor and the at least one actuator of each of the transmission assemblies are configured to be powered and connected wirelessly within that transmission assembly.

5. The intelligent well system according to claim 2, wherein the sensor comprises at least one of:

a temperature sensor;

a pressure sensor;

a flow sensor; or a resistivity sensor.

6. The intelligent well system according to claim 2, wherein data collected by the at least one sensor is transmitted through a wireless connection to the surface communication device in a continuous feedback loop.

7. The intelligent well system according to claim 1, wherein the second main bore transmission unit and the first lateral bore transmission unit are configured to establish a wireless connection there between, such that at least one of power or telemetry can be wirelessly transmitted.

8. The intelligent well system according to claim 1, wherein the first main bore transmission assembly is wirelessly connected to the surface communication device.

9. The intelligent well system according to claim 1, further comprising a third lateral bore transmission assembly disposed in a separate lateral bore and comprising a third lateral bore transmission unit, wherein the third lateral bore transmission unit and the first main bore transmission unit are configured to establish a wireless connection there between, such that at least one of power or telemetry can be wirelessly transmitted.

10. The intelligent well system according to claim 9, wherein each of the transmission units is configured to establish a wireless connection with each of the other transmission assemblies, such that at least one of power or telemetry can be wirelessly transmitted.

11. A method of transmitting data and energy through an intelligent well system, comprising:

disposing a first main bore transmission assembly in a main bore;

disposing a first lateral bore transmission assembly in a lateral bore;

disposing a second main bore transmission assembly in the main bore;

disposing a second lateral bore transmission assembly in the lateral bore;

establishing a wireless connection between the first main bore transmission assembly and the first lateral bore transmission assembly, such that at least one of power or telemetry can be wirelessly transmitted;

establishing a wireless connection between the first main bore transmission assembly and the second main bore transmission assembly, such that at least one of power or telemetry can be wirelessly transmitted;

establishing a wireless connection between the first lateral bore transmission assembly and the second lateral bore transmission assembly, such that at least one of power or telemetry can be wirelessly transmitted; and connecting the first main bore transmission assembly to a surface communication device.

12. The method according to claim 11, further comprising installing at least one sensor and at least one actuator into each of the transmission assemblies.

13. The method according to claim 12, further comprising connecting the at least one sensor and the at least one actuator of each of the transmission assemblies with a wire within that transmission assembly.

14. The method according to claim 12, further comprising wirelessly connecting the at least one sensor and the at least one actuator within each of the transmission assemblies, and wirelessly connecting the first main bore transmission assembly to the surface communication device.

15. The method according to claim 12, further comprising transmitting data collected by the at least one sensor through a wireless connection to the surface communication device in a continuous feedback loop.

16. The method according to claim 11, further comprising establishing a wireless connection between the second main bore transmission assembly and the first lateral bore transmission assembly, such that at least one of power or telemetry can be wirelessly transmitted.

17. The method according to claim 11, further comprising:

disposing a third lateral bore transmission assembly in a separate lateral bore; and establishing a wireless connection between the third lateral bore transmission assembly and the first main bore transmission assembly, such that at least one of power or telemetry can be wirelessly transmitted.

18. The method according to claim 17, further comprising establishing a wireless connection among each of the transmission assemblies, such that at least one of power or telemetry can be wirelessly transmitted.

* * * * *